US008360255B2

(12) United States Patent
Chen

(10) Patent No.: US 8,360,255 B2
(45) Date of Patent: Jan. 29, 2013

(54) INTEGRALLY FORMED SHELF

(75) Inventor: Hong-Jun Chen, Taipei (TW)

(73) Assignee: Pegatron Corporation, Taipei (TW)

( * ) Notice: Subject to any disclaimer, the term of this patent is extended or adjusted under 35 U.S.C. 154(b) by 94 days.

(21) Appl. No.: 13/009,900

(22) Filed: Jan. 20, 2011

(65) Prior Publication Data

US 2011/0192814 A1 Aug. 11, 2011

(30) Foreign Application Priority Data

Feb. 8, 2010 (TW) ..... 99202621 U

(51) Int. Cl.
*A47F 5/00* (2006.01)

(52) U.S. Cl. ..... 211/135; 211/188; 211/194

(58) Field of Classification Search ..... 211/135, 211/188, 72, 73, 126.16, 194, 49.1, 132.1; 248/174; 229/171, 917; 206/45.25, 501, 206/821; 220/62
See application file for complete search history.

(56) References Cited

U.S. PATENT DOCUMENTS 1,898,056 A * 2/1933 Johnson ..... 229/122.1
4,382,526 A * 5/1983 Stone ..... 221/34
4,708,240 A * 11/1987 McMahon et al. ..... 206/503
4,881,685 A * 11/1989 Isao ..... 229/115
4,911,311 A * 3/1990 Nagai ..... 211/126.16
5,758,783 A * 6/1998 Maglione ..... 211/126.2
5,984,120 A * 11/1999 Johnske ..... 211/132.1
6,578,717 B2 6/2003 Pickett
2010/0108623 A1 * 5/2010 Virvo ..... 211/49.1

FOREIGN PATENT DOCUMENTS

CN 2464187 12/2001

OTHER PUBLICATIONS

English translation of abstract of CN 2464187.

* cited by examiner

*Primary Examiner* — Korie H. Chan
(74) *Attorney, Agent, or Firm* — McClure, Qualey & Rodack, LLP

(57) ABSTRACT

An integrally formed shelf used for being fastened to another shelf includes a main body, a back plate, and two side plates. The main body includes a first bottom plate and a second bottom plate stacked to each other. The main body has a bottom edge and two side edges, and the two side edges are connected with the bottom edge, respectively. The back plate is connected with the bottom edge, and the back plate includes a first fastening sheet extending from the bottom edge. The two side plates are connected with two sides of the back plate. Part of the respective side plate is sandwiched between the first bottom plate and the second bottom plate, and each of the side plates includes a second fastening sheet extending from the side edge.

7 Claims, 9 Drawing Sheets

INTEGRALLY FORMED SHELF

CROSS-REFERENCE TO RELATED APPLICATIONS

This Non-provisional application claims priority under 35 U.S.C. §119(a) on Patent Application No(s). 099202621 filed in Taiwan, Republic of China on Feb. 8, 2010, the entire contents of which are hereby incorporated by reference.

BACKGROUND OF THE INVENTION

1. Field of the Invention

This invention relates to a shelf and, more particularly, to an integrally formed shelf.

2. Description of the Related Art

Common users may generally select a shelf or a bookrack for placing objects or books. Further, bookracks made of corrugated paper are developed to protect environment and save costs. Since the corrugated paper is light, the bookracks can be conveniently moved by the users.

At present, the bookrack made of the corrugated paper is mostly formed by cutting and combining a plurality of sheets of corrugated paper. If the bookracks are stacked to each other to form a multilayer bookrack, the bookracks need to be fixed in a sticking mode such as using twin adhesive tapes or glue to stick the bookracks to form the multilayer bookrack. Otherwise, other assembling equipment such as plastic fastening elements may be used to combine and fix the bookracks.

However, the bookrack combined by the above mode may consume much corrugated paper and may also directly cause too much costs. In addition, the bookrack is combined by sticking or other equipment, so that the layer of the bookrack fails to correspond to needs of users, which mostly causes inconvenience of the users.

BRIEF SUMMARY OF THE INVENTION

This invention provides an integrally formed shelf for being fastened to another shelf The shelf includes a main body, a back plate, and two side plates. The main body includes a first bottom plate and a second bottom plate stacked to each other. The main body has a bottom edge and two side edges, and the two side edges are connected with the bottom edge, respectively. The back plate is connected with the bottom edge, and the back plate includes a first fastening sheet extending from the bottom edge. The two side plates are connected with two sides of the back plate. Part of the respective side plate is sandwiched between the first bottom plate and the second bottom plate, and each of the side plates includes a second fastening sheet extending from the side edge.

In one embodiment of the invention, each of the side plates may further include a connecting sheet and a positioning sheet. The connecting sheet is connected with the back plate. The positioning sheet is connected with one side of the connecting sheet and is bent to be located between the first bottom plate and the second bottom plate which are stacked to each other. Each of the side plates may further include a mounting sheet. The mounting sheet is connected with the other side of the connecting sheet and is bent to be stacked to the connecting sheet.

In one embodiment of the invention, the mounting sheet may include a plurality of locking portions, and the positioning sheet may include at least one positioning portion. At least one of the locking portions may be embedded into the positioning portion to position the connecting sheet and the mounting sheet. The mounting sheet may further include an embedding portion, and the back plate may include a positioning hole. The embedding portion may be embedded into the positioning hole to position the mounting sheet and the back plate.

In the invention, the integrally formed shelf is formed after bent thus to be capable of placing objects. The first fastening sheet is fastened to an inner side of a back plate of another shelf to prevent the shelf from moving caused by pressure. The second fastening sheet is fastened to an outer side of a side plate of another shelf, thereby fastening two stacked shelves. Via the interlaced fastening structure, the stacked shelves can be stable without other auxiliary objects, thereby improving the prior art.

These and other features, aspects, and advantages of the present invention will become better understood with regard to the following description, appended claims, and accompanying drawings.

DETAILED DESCRIPTION OF THE INVENTION

Figure 1:
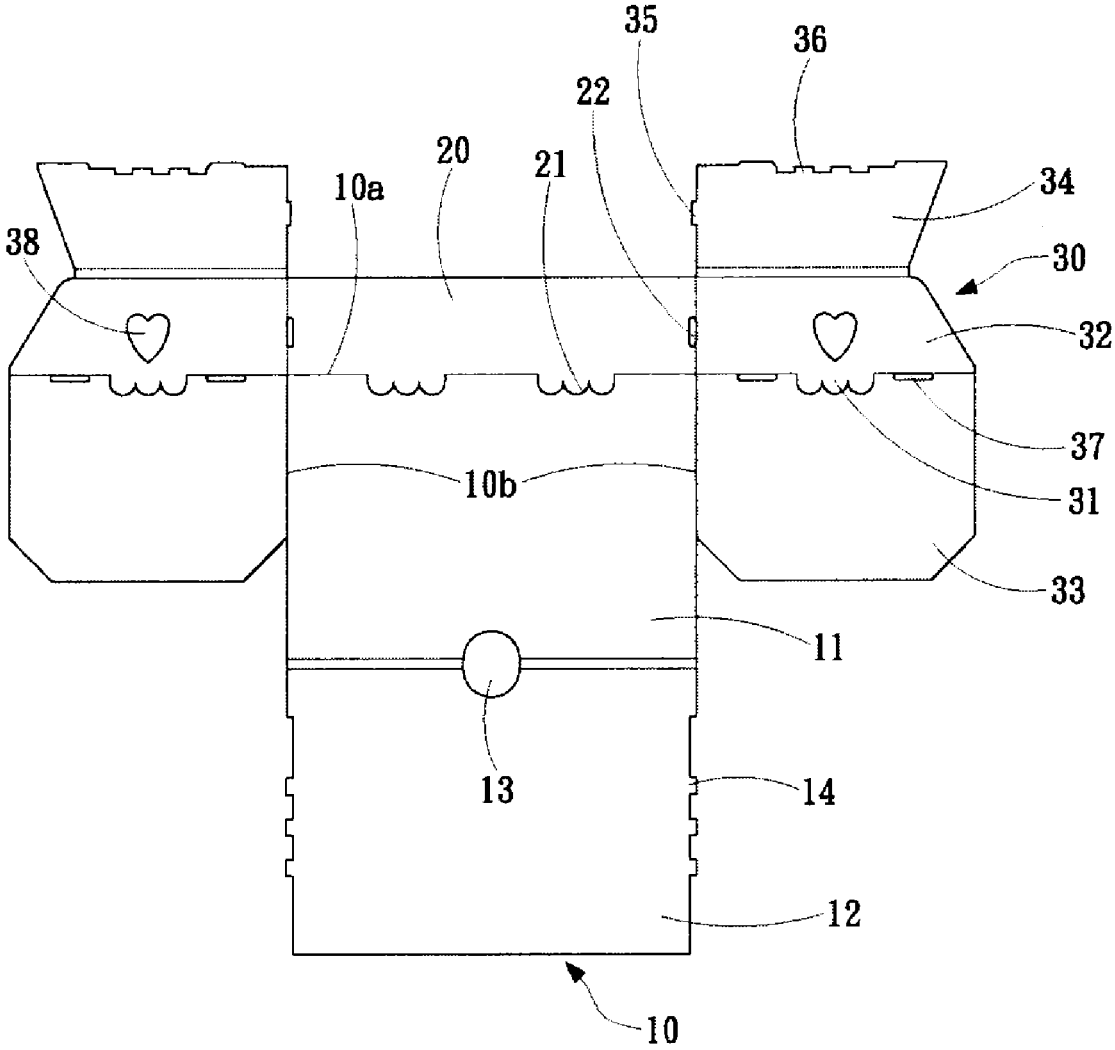
FIG. 1 is a plane schematic diagram showing an integrally formed shelf according to one embodiment of the invention.

FIG. 1 is a plane schematic diagram showing an integrally formed shelf according to one embodiment of the invention. FIG. 2A to FIG. 2F are schematic diagrams showing assembly of an integrally formed shelf according to one embodiment of the invention. FIG. 3 is a schematic diagram showing a shelf according to one embodiment of the invention. In the embodiment, an integrally formed shelf may be preferably made of corrugated paper. The shelf includes a main body 10, a back plate 20, and two side plates 30.

The main body 10 mainly includes a first bottom plate 11 and a second bottom plate 12. The main body 10 has a bottom edge 10*a* and two side edges 10*b*, and the two side edges 10*b* are connected with the bottom edge 10*a*, respectively. The first bottom plate 11 and the second bottom plate 12 are a rectangular sheet, respectively, and the first bottom plate 11 is connected with the second bottom plate 12. In addition, the main body 10 has an opening 13 at the connecting place of the first bottom plate 11 and the second bottom plate 12. Part of the opening 13 is located at the first bottom plate 11, and the other portion is located at the second bottom plate 12. In the embodiment, the opening 13 may be preferably a symmetrical circle, and the opening 13 is located at the connecting place of the first bottom plate 11 and the second bottom plate 12. In addition, the opening 13 may also be other symmetrical figures. When the first bottom plate 11 and the second bottom plate 12 are bent along the connecting place, the portion of the opening 13 located at the first bottom plate 11 is stacked on that located at the second bottom plate 12. However, the invention is not limited thereto. In addition, the second bottom plate 12 has a plurality of combining portions 14 extending from two sides thereof, and the combining portions 14 are opposite to each other. In the embodiment, the combining portions 14 are rectangular sheets, and each of the combining portions 14 has an interval with other combining portions 14. In the embodiment, there are preferably three combining portions 14 at one side of the second bottom plate 12. However, the invention is not limited thereto. The number of the combining portion 14 can be set according to needs of an actual structure.

The back plate 20 is a rectangular sheet. The back plate 20 is connected with the bottom edge 10*a* and is opposite to the second bottom plate 12. The back plate 20 has positioning holes 22 located at one side of the back plate 20, respectively, and the positioning holes 22 are opposite to each other. In addition, the back plate 20 further includes a first fastening sheet 21. The first fastening sheet 21 extends from the bottom edge 10*a*, such that the first fastening sheet 21 is located at the connecting place of the back plate 20 and the first bottom plate 11. The first fastening sheet 21 is preferably a wavy sheet. However, the above shape of the first fastening sheet 21 is just taken for example. The invention is not limited thereto. The first fastening sheet 21 may further be a rectangular sheet or a sheet with other shapes. In addition, there are preferably two first fastening sheets 21 in the embodiment. However, the invention is not limited thereto. The number of the first fastening sheet 21 can be set according to the size of the back plate 20.

The two side plates 30 are connected with two sides of the back plate 20 and are opposite to each other. Each of the side plates 30 includes a second fastening sheet 31. The second fastening sheets 31 extend from the side edges 10*b*, respectively. The second fastening sheet 31 is preferably a wavy sheet. However, the above shape of the second fastening sheet 31 is just taken for example. The invention is not limited thereto. The second fastening sheet 31 may be a rectangular sheet or a sheet with other shapes. In addition, each of the side plates 30 further includes a connecting sheet 32 connected with one side of the back plate 20. Each of the connecting sheets 32 further includes a hollow portion 38. The hollow portion 38 is a heart-shaped gap for decorating the side plate 30 to enhance aesthetics of the side plate 30. The heart-shaped gap is just taken for example. The hollow portion 38 can have other shapes such as a circle, a square, or other patterns with a decoration effect.

In addition, the side plate 30 further includes a rectangular positioning sheet 33 connected with one side of the connecting sheet 32. The positioning sheet 33 further includes a positioning portion 37. The positioning portion 37 is a strip-shaped aperture located at a connecting place of the positioning sheet 33 and the connecting sheet 32. In the embodiment, the number of the positioning portion 37 is preferably two. The above shape and the number of the positioning sheet 33 are just taken for example. However, the invention is not limited thereto.

In addition, each of the side plates 30 further includes a mounting sheet 34 connected with the other side of the connecting sheet 32, and the mounting sheet 34 is opposite to the positioning sheet 33. The mounting sheet 34 has an embedding portion 35. The embedding portion 35 is a rectangular sheet. However, the invention is not limited thereto. The second fastening sheet 31 is located between the connecting sheet 32 and the positioning sheets 33. The second fastening sheet 31 is preferably a wavy sheet. However, the above shape of the second fastening sheet 31 is just taken for example. The invention is not limited thereto. The second fastening sheet 31 may further be a rectangular sheet or a sheet with other shapes. In addition, each of the side plates 30 may preferably include one second fastening sheet 31. However, the invention is not limited thereto. The number of the second fastening sheet 31 can be set according to the size of the side plate 30.

In addition, the mounting sheet 34 further includes a plurality of locking portions 36. The locking portions 36 are located at one side of the mounting sheet 34, and at least one of the locking portions 36 is embedded into the combining portion 14 and the positioning portion 37. The shape of the locking portion 36 can be set according to the shapes of the combining portion 14 and the positioning portion 37.

Figure 2A:
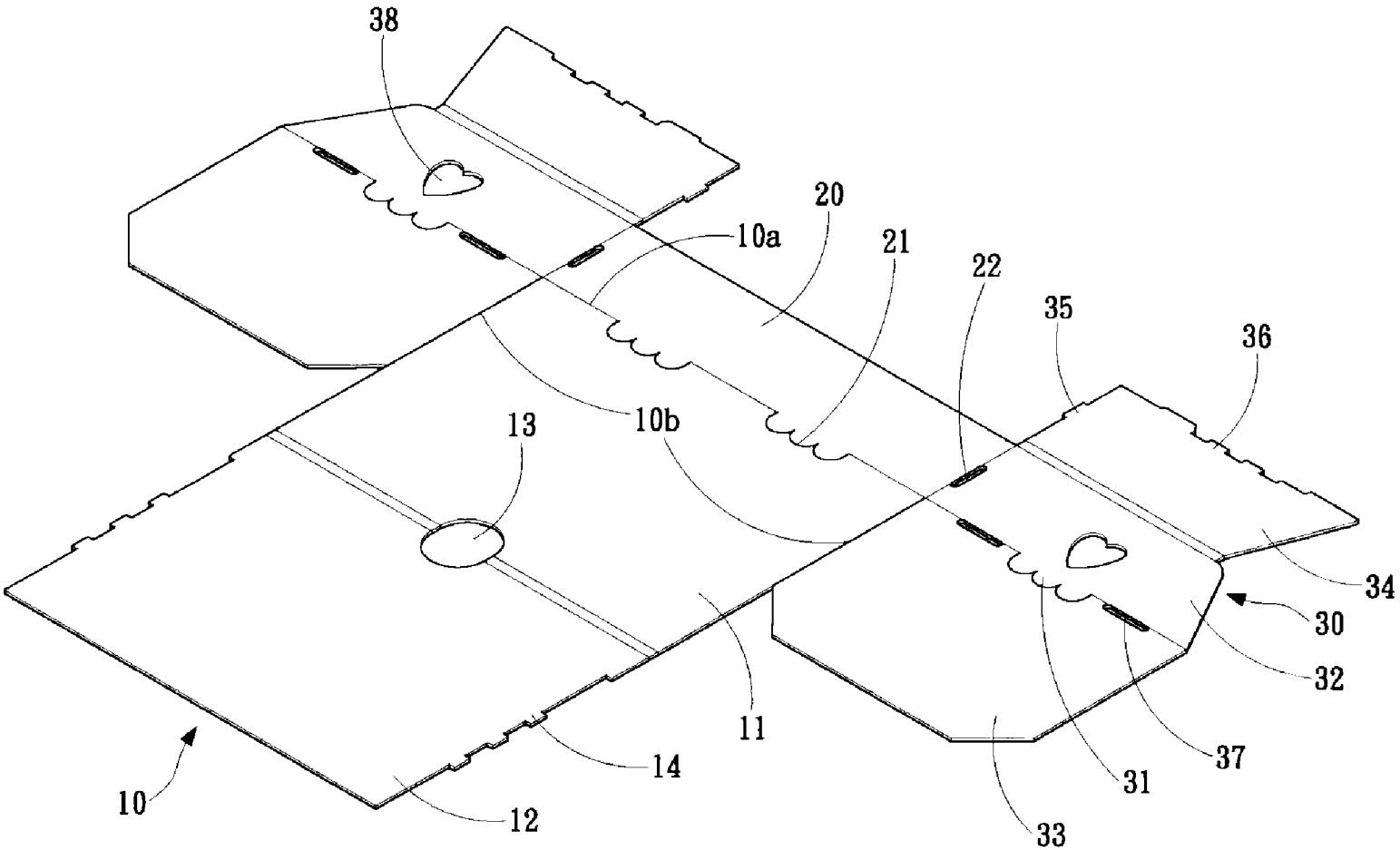
FIG. 2A is a first schematic diagram showing assembly of an integrally formed shelf according to one embodiment of the invention.
Figure 2B:
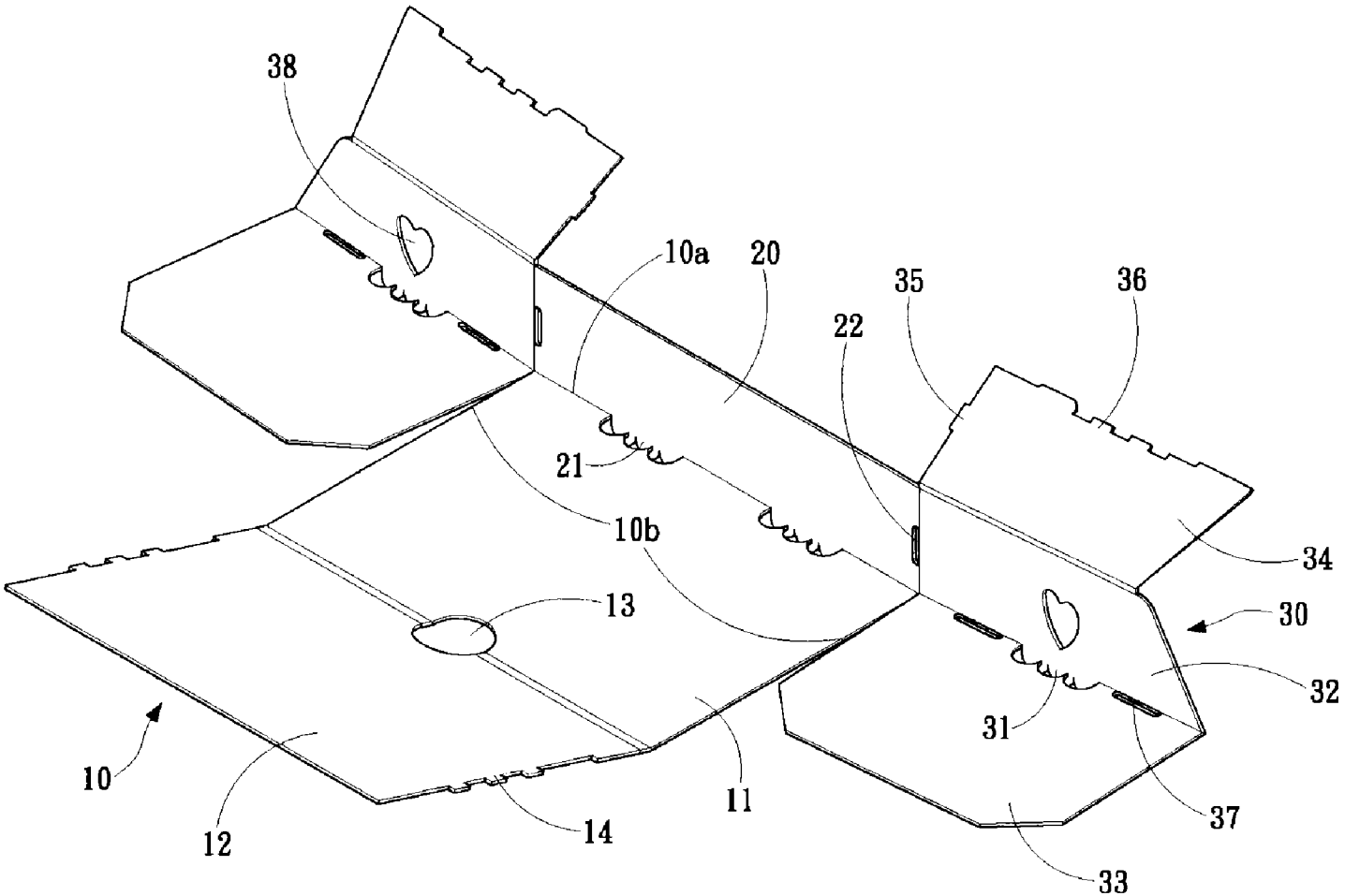
FIG. 2B is a second schematic diagram showing assembly of an integrally formed shelf according to one embodiment of the invention.
Figure 3:
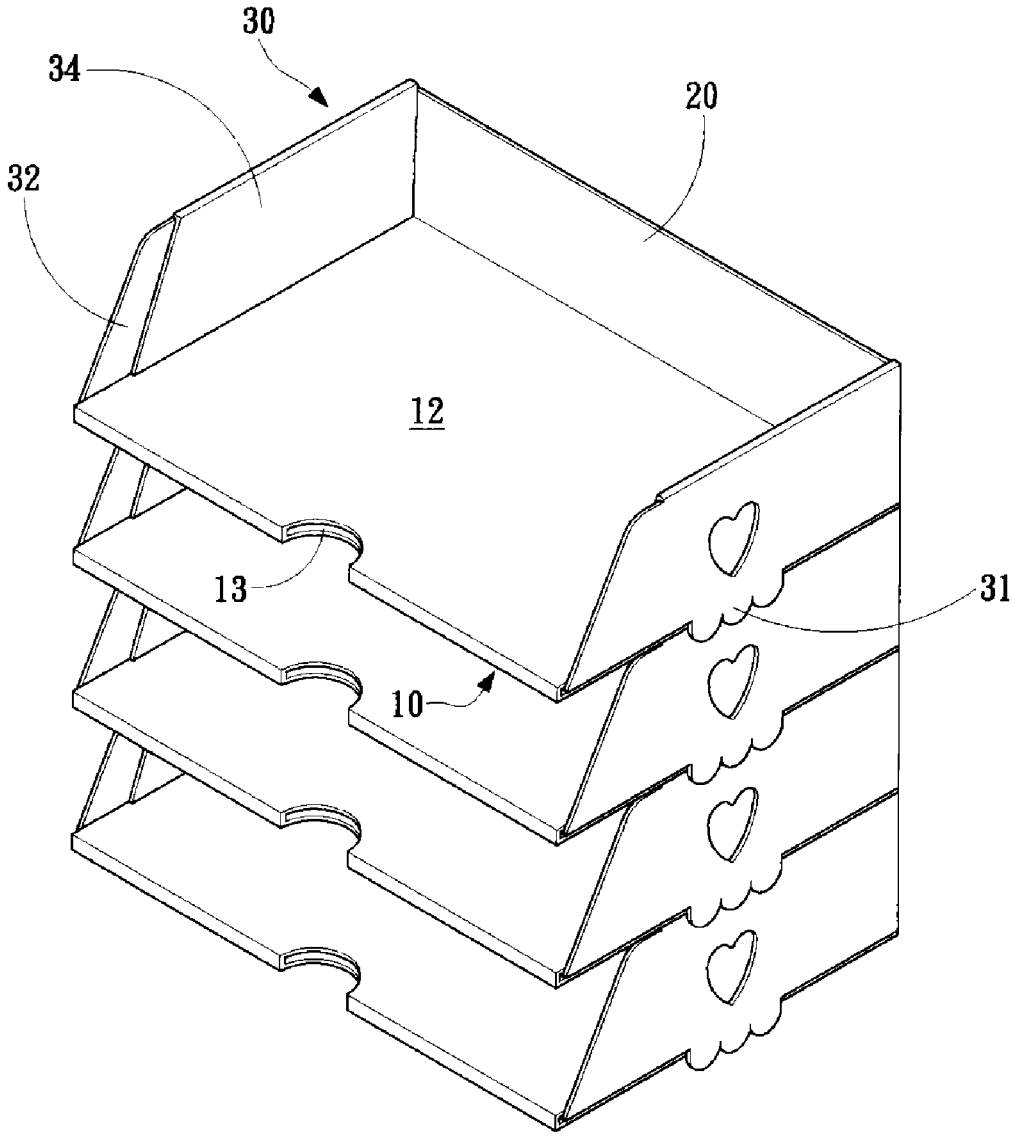
FIG. 3 is a schematic diagram showing a shelf according to one embodiment of the invention.

In FIG. 2A and FIG. 2B, when the integrally formed shelf is to be assembled, first the back plate 20 is bent toward the first bottom plate 11. At that moment, the first fastening sheet 21 is located at the bottom edge 10*a*. The connecting sheets 32 are driven to bend toward the first bottom plate 11.

Figure 2C:
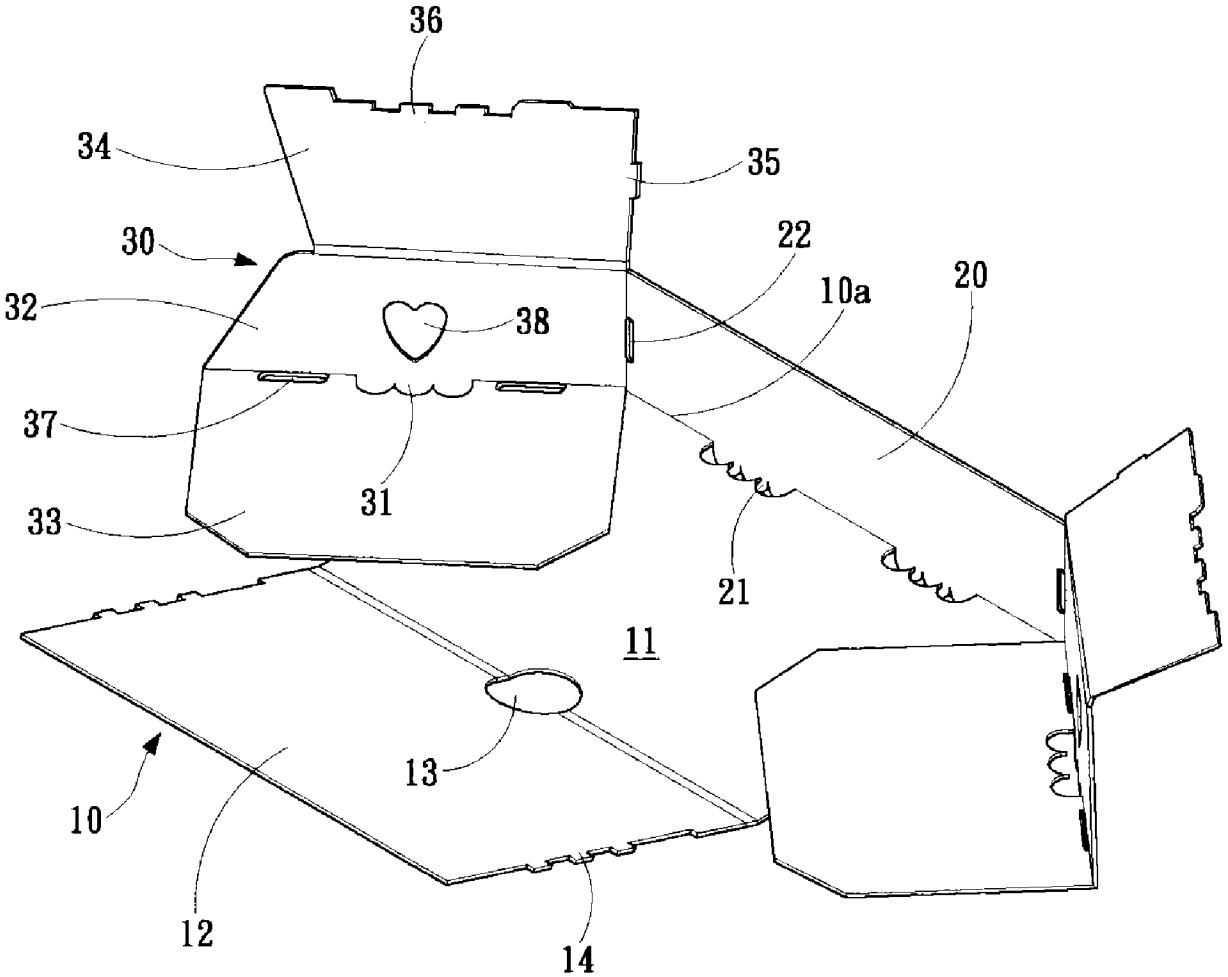
FIG. 2C is a third schematic diagram showing assembly of an integrally formed shelf according to one embodiment of the invention.

In FIG. 2C, the connecting sheets 32 are then bent toward the back plate 20, further to drive the positioning sheets 33 to bend toward the back plate 20. In the embodiment, in FIG. 2D, the positioning sheets 33 are bent to be located on the first bottom plate 11. Then, the second bottom plate 12 is bent toward the first bottom plate 11, and the second bottom plate 12 is stacked on the first bottom plate 11 and covers the positioning sheets 33 to allow the positioning sheets 33 to position the two side plates 30 via cover of the first bottom plate 11 and the second bottom plate 12 and to allow the positioning sheets 33 to be located between the first bottom plate 11 and the second bottom plate 12 which are stacked to each other. The side plates 30 are bent to be located at two sides of the first bottom plate 11, and part of the respective side plate 30 is sandwiched between the first bottom plate 11 and the second bottom plate 12. At the same time, the second fastening sheets 31 are located at the side edges 10*b*, respectively. In addition, when the second bottom plate 12 is bent, part of the opening 13 located at the second bottom plate 12 is stacked on part of the opening 13 located at the first bottom plate 11, thus to allow the opening 13 to form a semicircular gap to facilitate taking objects by users.

Figure 2D:
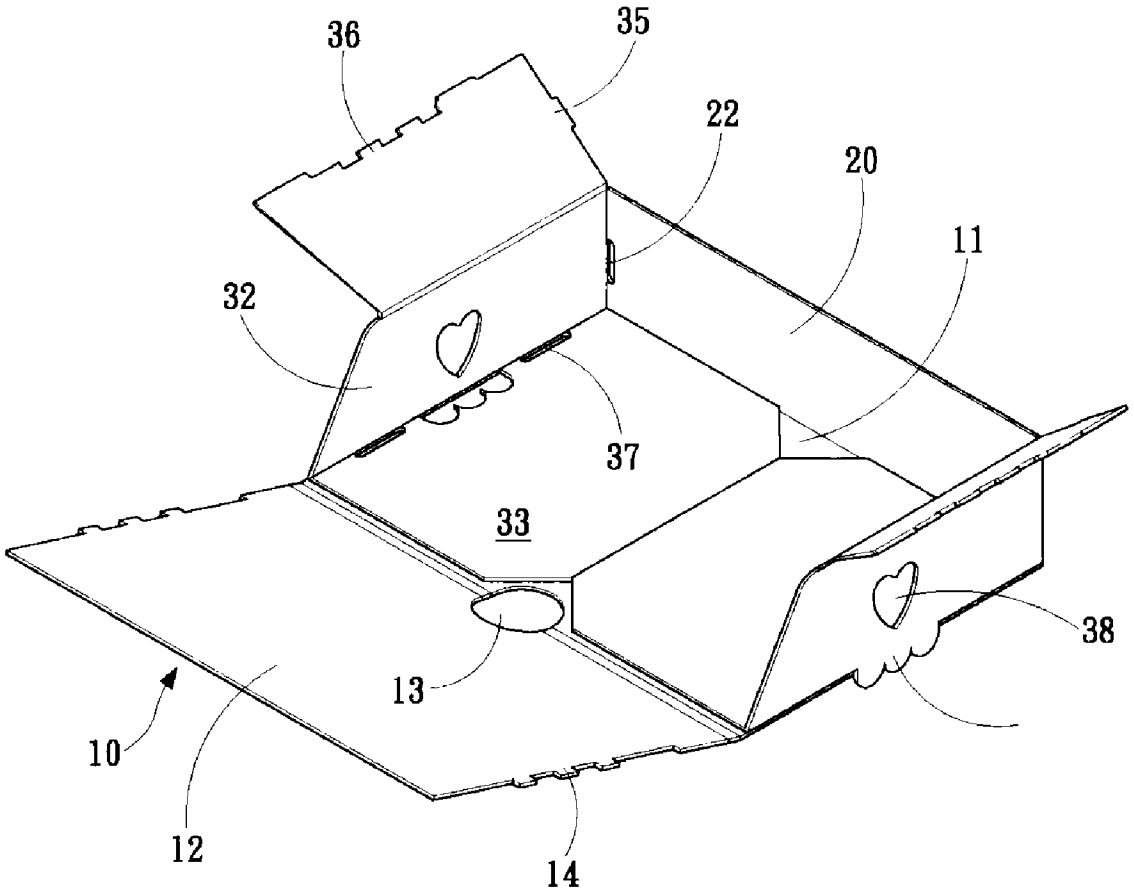
FIG. 2D is a fourth schematic diagram showing assembly of an integrally formed shelf according to one embodiment of the invention.
Figure 2E:
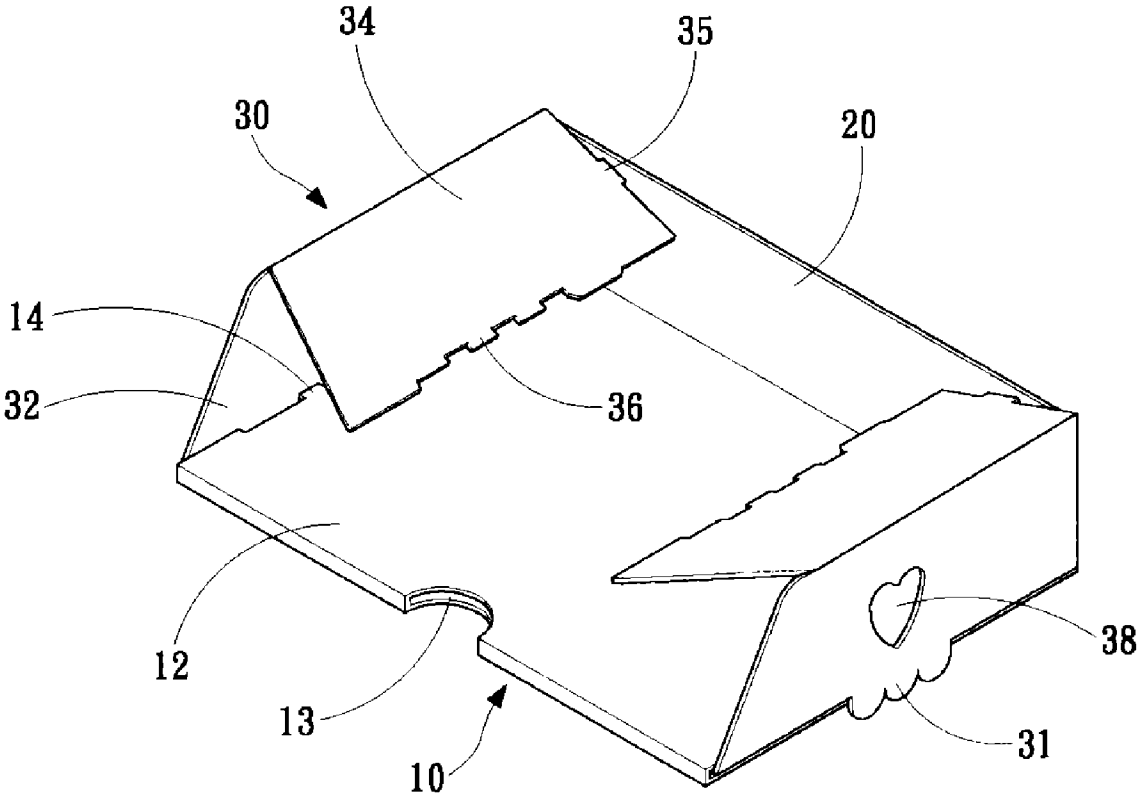
FIG. 2E is a fifth schematic diagram showing assembly of an integrally formed shelf according to one embodiment of the invention.
Figure 2F:
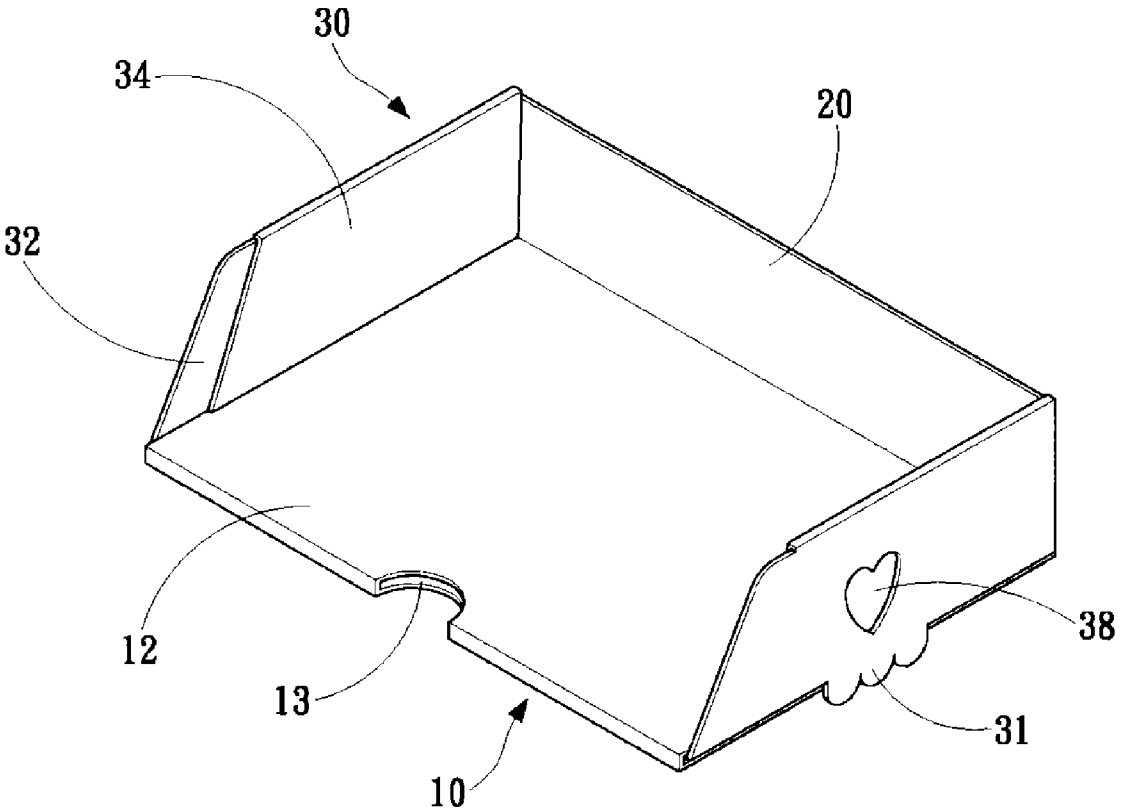
FIG. 2F is a sixth schematic diagram showing assembly of an integrally formed shelf according to one embodiment of the invention.

In FIG. 2D and FIG. 2E, the mounting sheets 34 are bent toward the connecting sheets 32 and are bent to be stacked to the connecting sheets 32. Thereby, the embedding portions 35 are embedded into the positioning holes 22 to position the mounting sheets 34 and the back plate 20. At the same time, the combining portions 14 are embedded into the locking portions 36 to position the mounting sheets 34 and the second bottom plate 12. In FIG. 2F, the assembled shelf is shown.

Figure 4:
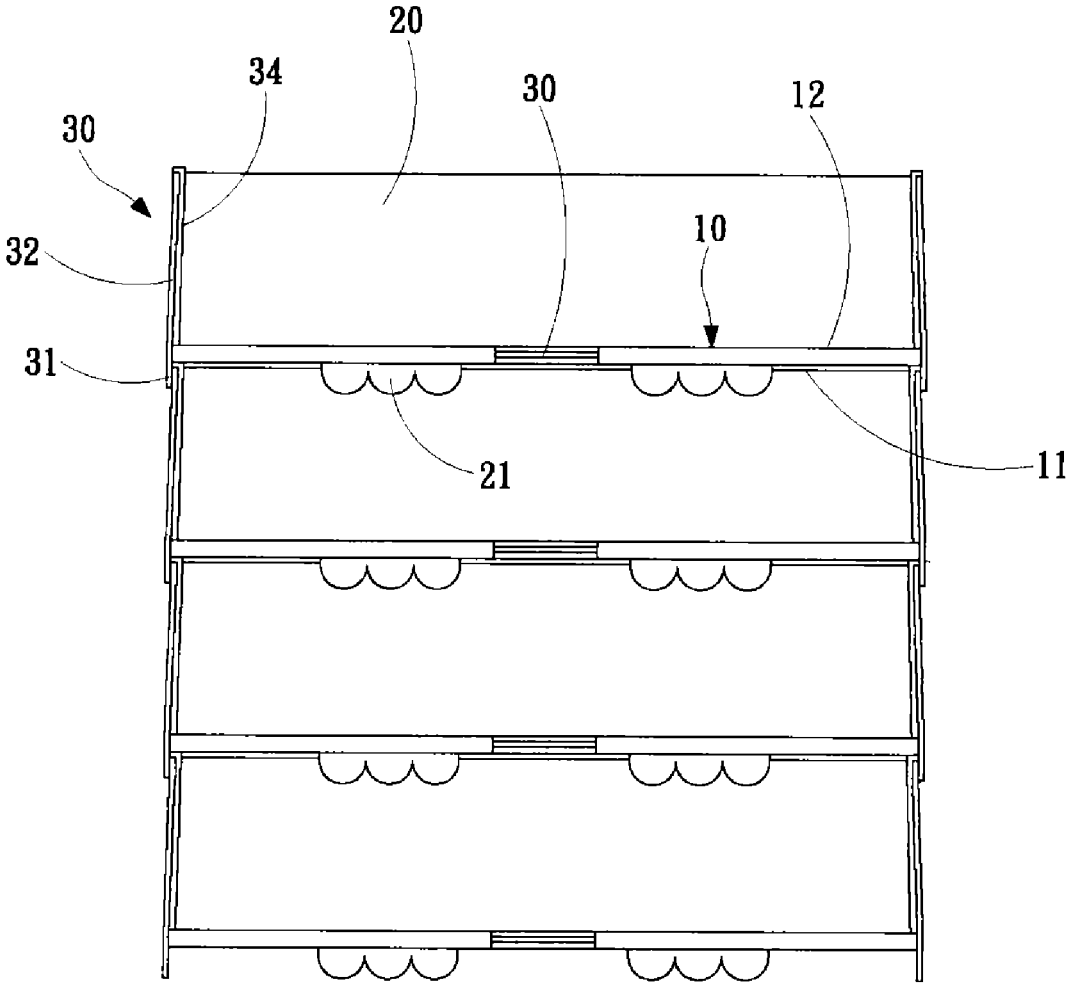
FIG. 4 is a front view showing a shelf according to one embodiment of the invention.

FIG. 4 is a front view showing a shelf according to one embodiment of the invention. In FIG. 4 and FIG. 3, the integrally formed shelf in the embodiment can be stacked to another shelf to form a multilayer shelf The first fastening sheet 21 and two second fastening sheets 31 of the shelf are fastened to an inner side and outer side of another shelf, respectively. When the shelves are stacked to each other, the first fastening sheet 21 is fastened to the inner side of a back plate 20 of another shelf to prevent the shelf from moving by pressure. At the same time, the second fastening sheets 31 are fastened to the outer side of two side plates 30 of another shelf. Since the size of each shelf is the same, when the second fastening sheets 31 are fastened to the side plates 30, the side plates 30 are pressed by the second fastening sheets 31. Thus, a force is generated to press the side plates 30, and a resisting force is generated via the elasticity of the side plates 30, thereby fastening two stacked shelves to form a multilayer shelf According to the integrally formed shelf in the embodiment of the invention, the corrugated paper in use can be saved, and the costs of the manufacturers can also be saved. In addition, the shelf can be combined without sticking or other auxiliary equipment. Therefore, in use, the layer of the shelf can change with the needs of the users, and the problem that other auxiliary objects are needed to assemble the shelves in the prior art can be solved.

Although the present invention has been described in considerable detail with reference to certain preferred embodiments thereof, the disclosure is not for limiting the scope of the invention. Persons having ordinary skill in the art may make various modifications and changes without departing from the scope and spirit of the invention. Therefore, the scope of the appended claims should not be limited to the description of the preferred embodiments described above.

What is claimed is:

1. An integrally formed shelf for being fastened to another shelf, comprising:

a main body including a first bottom plate and a second bottom plate stacked to each other, the main body having a bottom edge and two side edges, the two side edges connected with the bottom edge, respectively;

a back plate connected with the bottom edge, the back plate including a first fastening sheet extending from the bottom edge; and two side plates connected with two sides of the back plate, part of the respective side plate sandwiched between the first bottom plate and the second bottom plate, each of the side plates including a second fastening sheet extending from the side edge, wherein each of the side plates further comprises:

a connecting sheet connected with the back plate; and a mounting sheet connected with one side of the connecting sheet and bent to be stacked to the connecting sheet, the mounting sheet including a plurality of locking portions, the second bottom plate including a plurality of combining portions embedded into the locking portions to position the mounting sheet and the second bottom plate.

2. The integrally formed shelf according to claim 1, wherein each of the side plates further comprises:

a positioning sheet connected with the other side of the connecting sheet and bent to be located between the first bottom plate and the second bottom plate which are stacked to each other.

3. The integrally formed shelf according to claim 1, wherein each of the connecting sheets further comprises a hollow portion.

4. The integrally formed shelf according to claim 2, wherein the second fastening sheet is located between the connecting sheet and the positioning sheet.

5. The integrally formed shelf according to claim 2, wherein the positioning sheet comprises at least one positioning portion, and at least one of the locking portions are embedded into the positioning portion to position the connecting sheet and the mounting sheet.

6. The integrally formed shelf according to claim 1, wherein the mounting sheet comprises an embedding portion, the back plate comprises a positioning hole, and the embedding portion is embedded into the positioning hole to position the mounting sheet and the back plate.

7. The integrally formed shelf according to claim 1, wherein the main body further comprises an opening, part of the opening is located at the first bottom plate, and the other portion of the opening is located at the second bottom plate.

* * * * *